United States Patent [19]

Ace, Jr., deceased et al.

[11] Patent Number: 4,536,162

[45] Date of Patent: Aug. 20, 1985

[54] CHILD'S PLAYSET

[75] Inventors: Marshall E. Ace, Jr., deceased, late of Los Angeles, Calif., by David L. Ramsey, executor; Ray W. Mattson, Venice; Mark S. Wittenberg, Anaheim, both of Calif.

[73] Assignee: Mattel, Inc., Hawthorne, Calif.

[21] Appl. No.: 482,374

[22] Filed: Apr. 5, 1983

[51] Int. Cl.[3] ..... A63H 33/08

[52] U.S. Cl. ..... 446/102; 446/110; 446/115; 446/487

[58] Field of Search ..... 46/16, 17, 18, 19, 21, 46/23, 26, 25, 12; 446/102, 104, 108, 110, 115, 476, 477, 478

[56] References Cited

U.S. PATENT DOCUMENTS

| | | | |
|---|---|---|---|
| 513,688 | 1/1894 | Smith | 46/12 |
| 1,302,785 | 5/1919 | Gilbert | 46/21 |
| 1,316,690 | 9/1919 | Crosby et al. | 46/19 |
| 1,541,556 | 6/1925 | Fisher | 46/31 |
| 1,567,849 | 12/1925 | Kliner | 46/21 |
| 2,062,735 | 12/1936 | Warren | 446/115 |
| 2,183,443 | 12/1939 | Bracker | 46/12 |
| 3,032,919 | 5/1962 | Amsler | 46/17 X |
| 3,363,360 | 1/1968 | Ryan | 46/12 |
| 3,516,389 | 6/1970 | Meyer | 46/21 X |
| 3,629,967 | 12/1971 | Bass | 46/12 |
| 3,691,671 | 9/1972 | Kroll | 46/12 |
| 4,131,227 | 12/1978 | Patton et al. | 46/21 X |
| 4,139,967 | 2/1979 | Kuna et al. | 46/12 |
| 4,161,081 | 7/1979 | Katzman et al. | 46/12 X |
| 4,214,403 | 7/1980 | Knudson | 46/23 X |

FOREIGN PATENT DOCUMENTS

| | | | |
|---|---|---|---|
| 797877 | 7/1958 | United Kingdom | 46/30 |

*Primary Examiner*—F. Barry Shay

*Attorney, Agent, or Firm*—Ronald M. Goldman; Melvin A. Klein

[57] ABSTRACT

A child's playset comprised of a number of rooms offering different stage settings which may be changed. Each room includes a pair of walls at an angle with respect to each other and a floor having two different heights. The playset is preferably formed by attaching four rooms together at hinges whereby the rooms may be moved with respect to each other to form different shaped playsets. In addition, the rooms may be brought together to form a square wherein a handle extending upwardly from the walls of each room come together to form a central carrying handle for transportation of the playset.

8 Claims, 11 Drawing Figures

Fig.1.
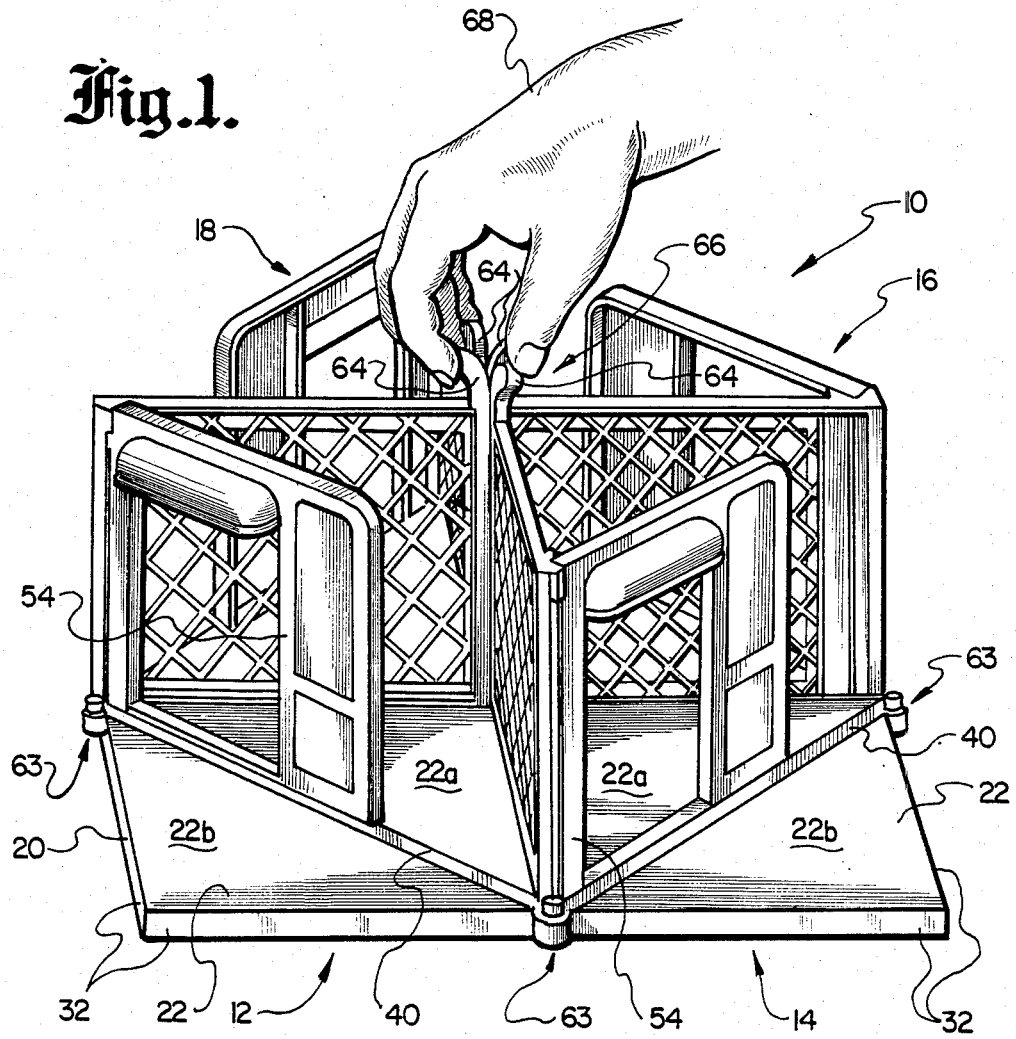
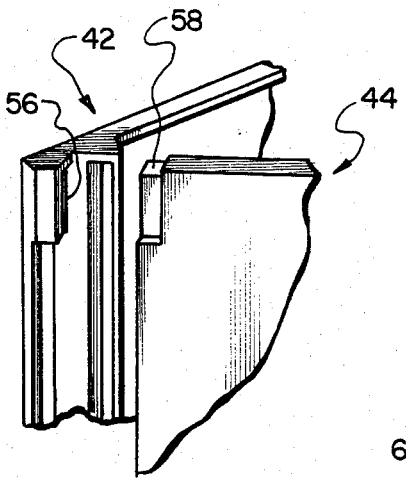
Fig.3.
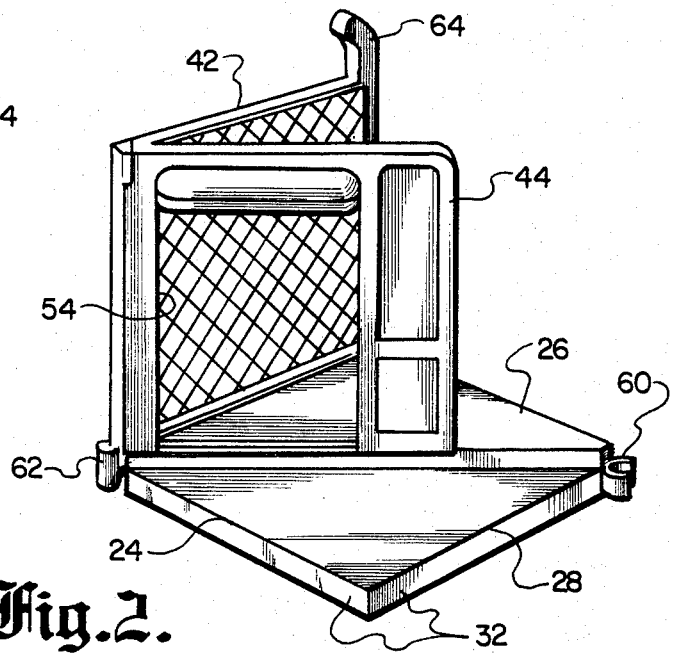
Fig.2.

Fig.4.
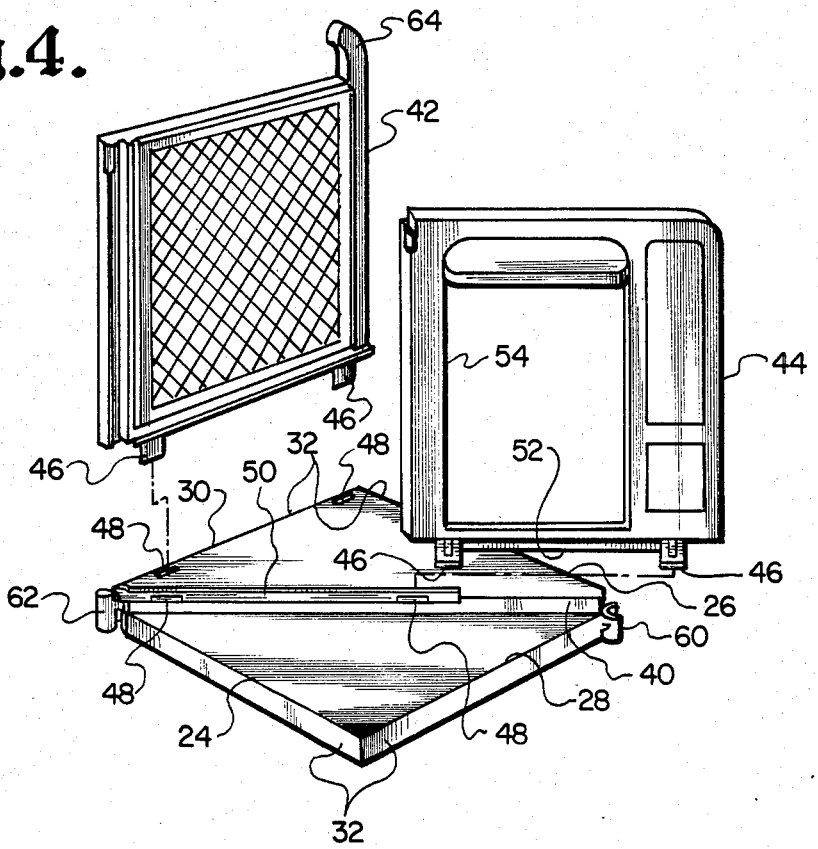
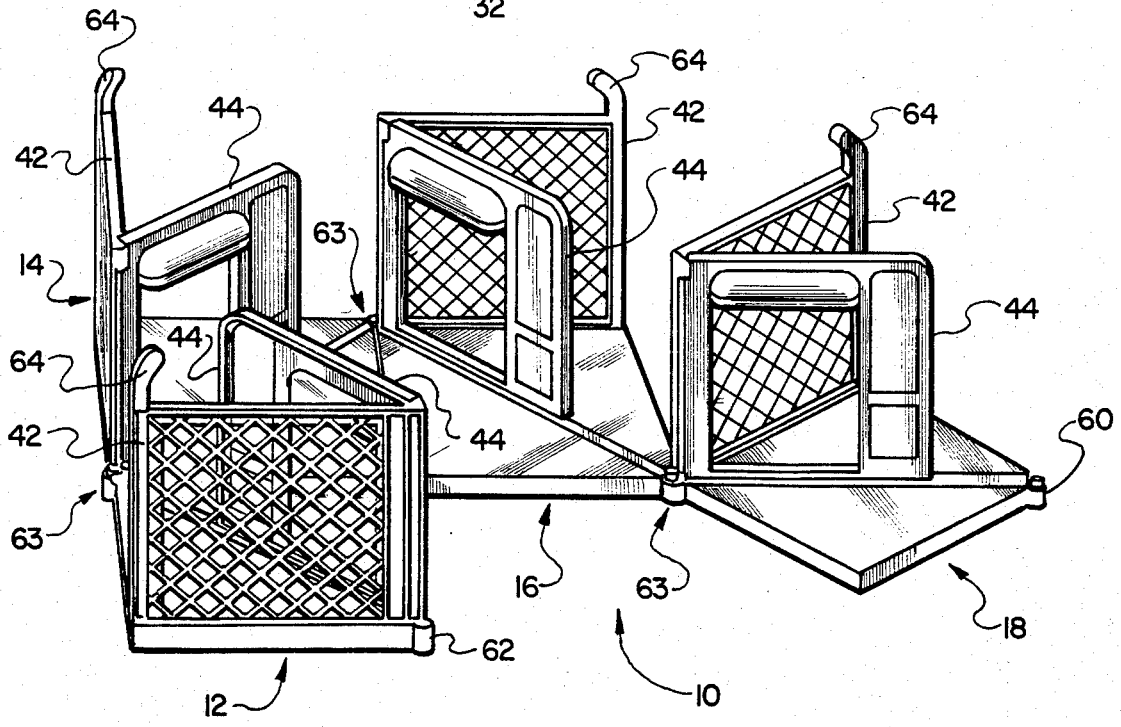
Fig.5.

CHILD'S PLAYSET

BACKGROUND OF THE INVENTION

This invention relates to a child's playset and in particular to a playset having a number of rooms articulately connected together whereby the rooms may be rotated in various directions with respect to each other.

Children's playsets and/or amusement sets are available having a variety of different themes to depict different stage-type settings to stimulate a child's imagination. However, as far as is known, none of the available or known playsets include a play situation which consists of four or more rooms having floors with two walls fixed to the floors and the rooms articulately fixed together for relative movement. In addition, no known playset includes rooms having handle means, and which rooms may be rotated with respect to each other to bring the handle means of each room together to form a central carrying means for easy transportation of the playset.

SUMMARY OF THE INVENTION

The present invention comprises a new and improved child's playset designed for use by children of all ages. The playset has a number of rooms each of which includes a rectangular base member. Each of the base members includes a floor, with two walls removably secured to the floor. In addition, each of the rectangular base members includes means fixed at diagonally opposite corners to enable any number of base members to be articulately connected together.

In a preferred embodiment of the invention, four rooms are connected together by hinge means and may be rotated with respect to each other to form various play situations, such as a square. In one position, the four rooms are rotated together whereby handle members, formed on one of the upwardly extending walls of each of the rooms, come together to form a central carrying means for transporting the playset.

BRIEF DESCRIPTION OF THE DRAWINGS

FIG. 1 is a perspective view of the playset of the present invention having four rooms fixed together at diagonally opposite corners, with the carrying handles brought together in the center of the playset to form a central carrying means capable of being grasped by the hand of a user;

FIG. 2 is a perspective view of one room of the playset of the instant invention showing two walls connected thereto;

FIG. 3 is an enlarged partial perspective view of the wall members of a room showing details of the means for holding the walls together;

FIG. 4 is a further prespective view showing a room with the walls removed from the floor;

FIG. 5 is a perspective view of the playset of the present invention having three room members rotated together, with a fourth room in an open position prior to being brought together with the remaining three rooms;

DESCRIPTION OF THE PREFERRED EMBODIMENT

Figure 6:
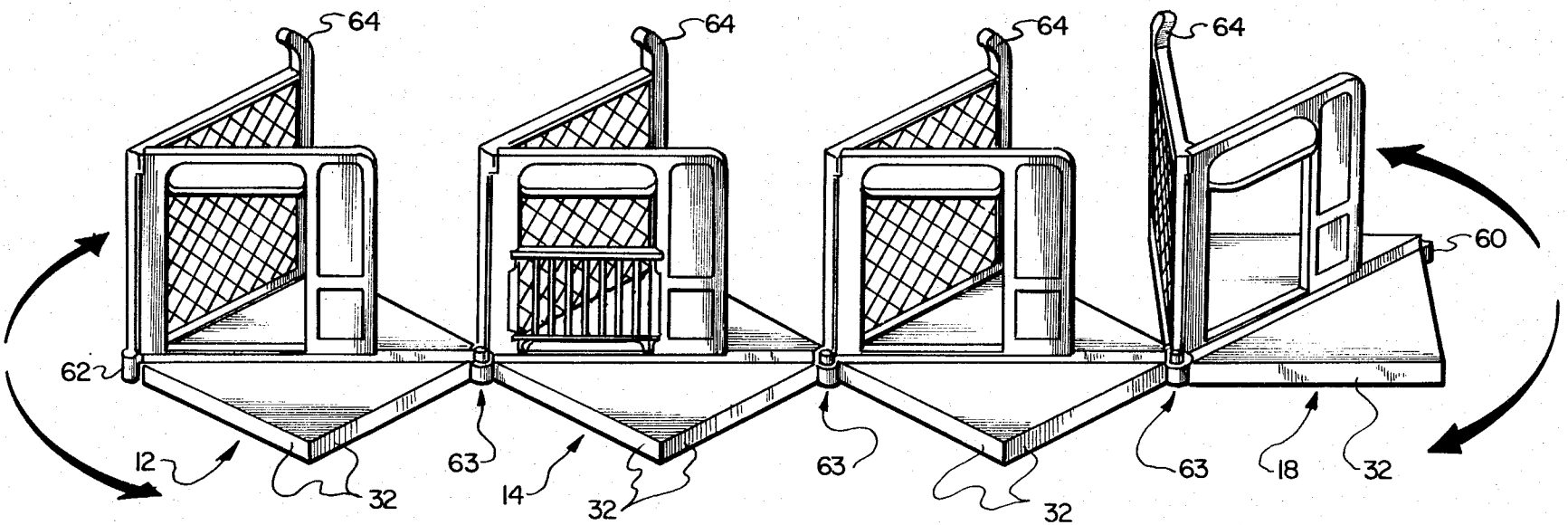
FIG. 6 is a perspective view showing four rooms of the present invention fixed together and extending in a substantially straight line.
Figure 7:
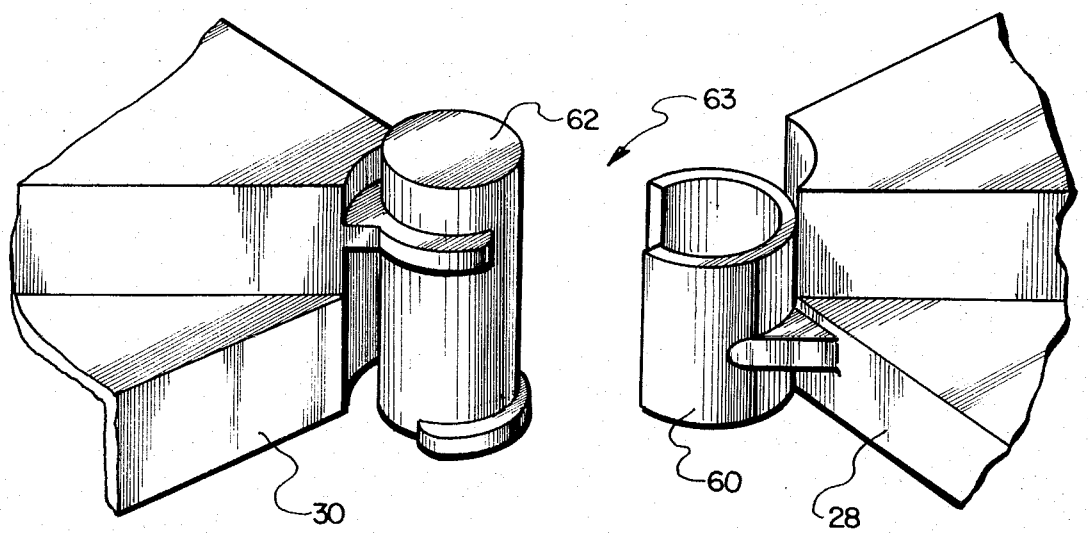
FIG. 7 is an enlarged partial perspective view showing opposed hinge members of two rooms in position to be brought together to fix two rooms together.

Referring now to the drawings wherein like reference numerals refer to like parts throughout the several views, there shown is a children's playset 10 comprised of a plurality of rooms 12, 14, 16, and 18. Any number of rooms may be fixed together, if desired. Each room includes a rectangular base member 20, preferrably square in shape and made from any desired material, such as a plastic. The base member including a floor 22 with a front edge 24, a rear edge 26, a first side edge 28, and a second side edge 30. An encompasing wall 32 is formed around the edges and extends downwardly therefrom.

The floor 22 is divided into different levels **22*a*, 22*b* along a line 34 extending diagonally, at least partially across the floor from one corner 36 of the rear edge 26 to the diagonally opposite corner 38 of the front edge 24. A separating wall 40 extends along the line 34 connecting the two different level floor sections 22*a*, 22*b***.

Each of the rooms includes a first wall 42, made from the same or similar material as the base member, removeably secured to the floor along one edge thereof, such as the second side edge 30. A second wall 44 is also removeably secured to the floor along the line 34 at an angle with respect to the first wall, so as to form a room having an entrance at level **22*b* and a stage or play area on level 22*a***. Furniture, figures, and/or changeable scenes may be easily inserted into or fixed to the wall members, or added to or taken from either or both levels, in any known manner.

Figure 8:
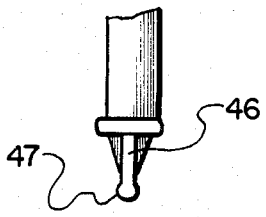
FIG. 8 is an enlarged partial front view of the bottom of a wall member showing the construction of a tab for fixing the wall member to a floor.

Each of the first and second wall members includes a pair of extending feet or tabs 46 having enlarged, rounded lower portions 47, as more clearly shown in the FIG. 8. The rounded lower portion 47 of each tab 46 is forced into and locked in holes 48 fromed along the line 34 and the second side edge 30 where they are fixedly held in position. The walls may be removed, if desired, by pulling the lower portions 47 from the holes, for storage and/or for changing of the rooms so that different playsets of stage settings may be provided.

Figure 9:
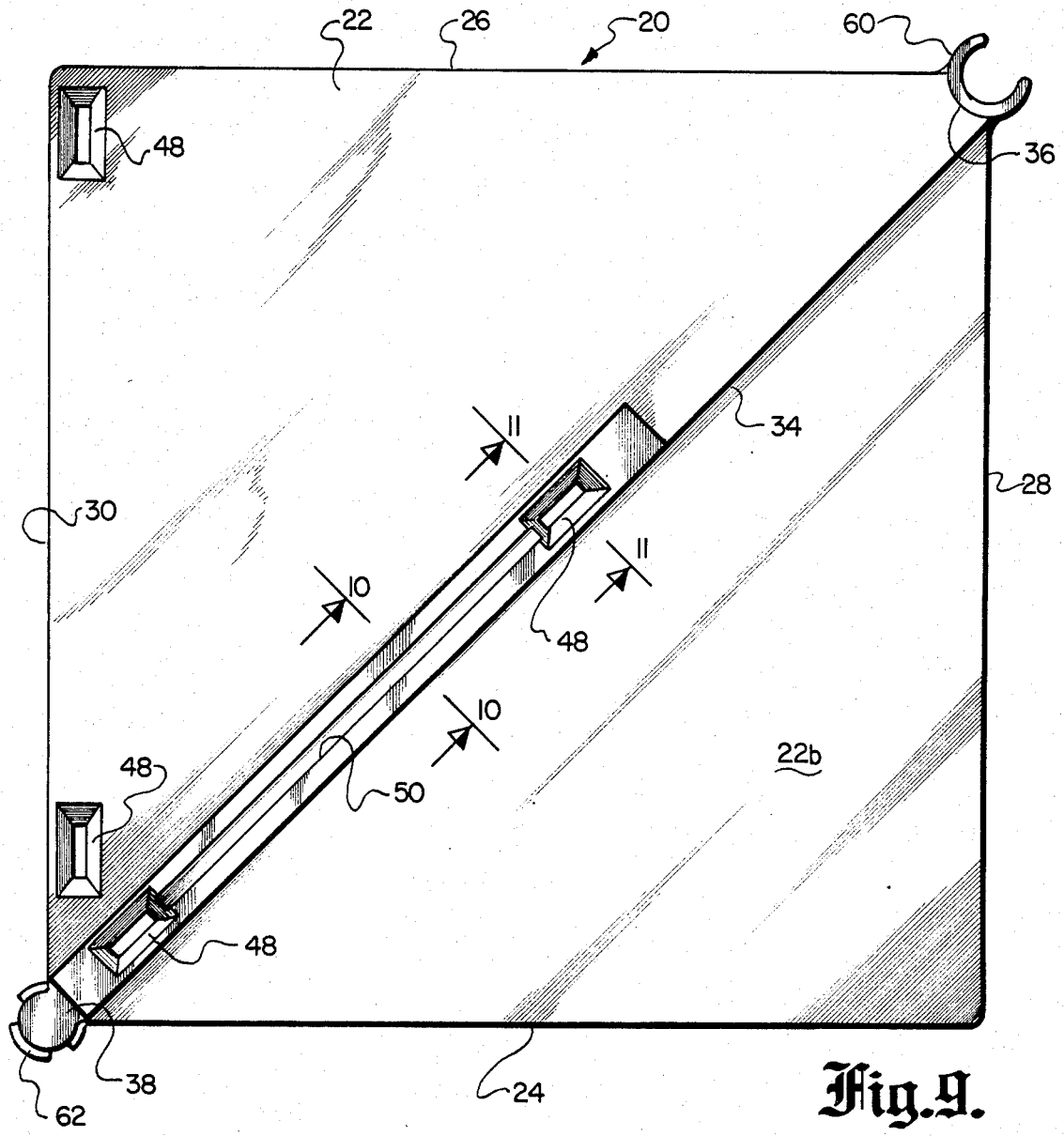
FIG. 9 is an enlarged plan view of a floor of one of the rooms.
Figure 10:
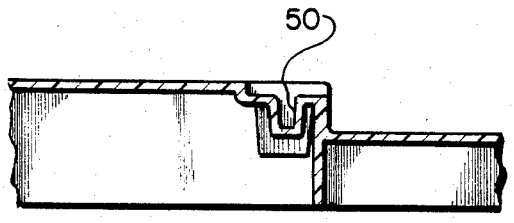
FIG. 10 is a partial sectional view taken along line 10—10 of FIG. 9.
Figure 11:
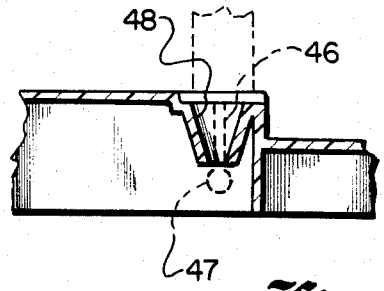
FIG. 11 is a partial sectional view taken along line 11—11 of FIG. 9.

As is shown more clearly in FIG. 9, the holes 48 along the second side edge 30 are preferrably spread apart enough so that a first wall 42 inserted therein forms a wall along substantially the entrie length of the second side edge. The holes 48 along the line 34, separating the different levels **22*a* and 22*b*, are spaced closer together and preferably include a slot 50 into which the lower portion 52 of the second wall 44 is inserted and held in place. In this manner, the second wall 44, which normally includes an open doorway or entrance 54 is securely held in place extending at least half way along the line 34**.

As shown in FIG. 3, the first wall 42 includes a holding slot 56 near the top thereof into which a reduced tap corner section 58 of the second wall 44 may be pressed to securely hold the walls together, at the desired angle in a base member. The first wall 42 in each of the rooms includes holding means whereby different backdrops, having different scenes thereon, may be inserted into and held in place to form different background settings for the rooms.

As shown most clearly in FIG. 4, the first wall 42 includes verticle side edges into which the back drops are fitted, as by bowing or bending the center of the back drops, fitting the edges thereof into the opposite side edges of the walls, and then pressing the same into position.

Any number of rooms may be fixed together at opposite diagonal corners by means of articulating means, such as hinge elements 63 formed by an open hinge member 60 at one corner and a rounded hinge member 62 at the opposite corner of diagonal line 34. In this manner, as shown more clearly in FIGS. 1, 5, and 6, a plurality of rooms, preferrably four, is fixed together by forcing the rounded hinge 62 of one room into the open hinge 60 of an adjacent room. The rooms are then articulated or turned with respect to each other around the hinges in etither direction to form different settings, such as: four or more rooms extending in a straight line; four rooms connected together, substantially as shown in FIG. 5 and fixed in position with the last hinge members 60, 62 fixed together to form a substantially square stage setting; turned in the opposite direction and brought together in the form of a square as shown in FIG. 1, wherein upwardly extending handle sections 64 formed at the top near one and of the first wall member 42 of each room are brought together in the center to form a central carrying means 66 which may be grasped by a single hand 68 of a user to enable the playset to be transported.

Although, the present invention has been described with reference to a single illustrative embodiment thereof, it should be understood that numerous other modifications and embodiments may readily occur to those skilled in the art, and consequently, it is intended that the claims be interpreted to cover all such modifications and equivalents.

What is claimed is:

1. A child's playset comprising:

a square base member including a generally horizontally extending floor having a front edge, a rear edge, a first side edge, and a second side edge, said base member also including an encompassing sidewall depending from said edges;

a first wall removably secured to said second side edge of said floor, said first wall including a handle member extending upwardly, away from said floor, whereby said playset may be picked up and transported;

a second wall removably secured to said floor along a line extending diagonally at least partially across said floor from one corner of said rear edge to the diagonally opposite corner of said front edge; and means affixed to diagonally opposite corners of said square base member to enable at least four playsets to be rotatably held together and rotated with respect to each other about axes perpendicular to said floors whereby said four playsets may be brought together to form an enlarged square.

2. A child's playset as recited in claim wherein said handle members on adjacent first walls are brought together into abutting relationship at the center of said enlarged square to form a central carrying handle.

3. A child's playset comprising:

a square base member including a generally horizontally extending floor having a front edge, a rear edge, a first side edge, and a second side edge, said floor being divided into two different levels by a wall extending diagonally across said floor along a line from one corner of said rear edge to the diagonally opposite corner of said front edge, said base member also including an encompassing sidewall depending downwardly from said edges.

a first wall removably secured in holes formed along said second side edge of said floor;

a second wall removably secured in holes formed along said line extending diagonally to partially separate and two different levels of said floor;

a first means affixed to said one corner of said rear edge and a second means affixed to said diagonally opposite corner of said front edge for articulately connecting a plurality of a said base members together for relative rotation about an axis perpendicular to said floor; and a handle member extending upwardly from said first wall, away from said floor, whereby a plurality of said playsets may be rotated about associated ones of said first and second means to bring associated ones of said handle members into abutting relationship.

4. A child's playset comprising:

a square base member including a floor having a front edge, a rear edge, a first side edge, and a second side edge, said floor being divided into two different levels by a wall extending diagonally across said floor along a line from one corner of said rear edge to the diagonally opposite corner of said front edge, said base member also including an encompassing sidewall depending downwardly from said edges;

a first wall removably secured in holes formed along said second side edge of said floor;

a second wall removably secured in holes formed along said line to partially separate said two different levels of said floor;

a first hinge element affixed to said one corner of said rear edge and a second hinge element affixed to said diagonally opposite corner of said front edge for articulately connecting four playsets together whereby said four playsets may be rotated with respect to each other about axes perpendicular to said floors to form different play configurations; and a handle member formed integrally with and extending upwardly, away from said floor, on said first walls secured in each of said four playsets, whereby said handle members on adjacent first walls may be brought together into abutting relationship to form a central carrying handle at the center of an enlarged square formed by said four playsets, when said playsets are rotated together to form an enlarged square.

5. A child's playset comprising:

a rectangular base member including a generally horizontally extending floor having a front edge, a rear edge, a first side edge, and a second side edge, said base member also including an encompassing sidewall depending from said edges;

a first wall removably secured to said second side edge of said floor;

a second wall removably secured to said floor along a line extending diagonally at least partially across said floor from one corner of said rear edge to the diagonally opposite corner of said front edge;

a first means affixed to said one corner of said rear edge and a second means affixed to said diagonally opposite corner of said front edge for articulately connecting a plurality of said base members together for relative rotation about an axis perpendicular to said floor; and a handle member extending upwardly from said first wall, whereby a plurality of said playsets may be rotated about associated ones of said first and second means to bring associated ones of said handle members into abutting relationship.

6. A child's playset as recited in claim 5 wherein said floor is divided into two different levels along said line extending diagonally across said floor, with said two levels partially separated by said second wall.

7. A child's playset as recited in claim 5 wherein said base member includes means affixed to diagonally opposite corners thereof to enable at least four playsets to be rotatably held together and rotated with respect to each other about an axis perpendicular to said floor whereby said four playsets may be brought together to form an enlarged square.

8. A child's playset as recited in claim 7 wherein said handle member on said first wall is such that said handle members on adjacent first walls of said four playsets may be brought together into abutting relationship at the center of said enlarged square to form a central carrying handle.

* * * * *